US009354614B2

(12) United States Patent
Dubois et al.

(10) Patent No.: US 9,354,614 B2
(45) Date of Patent: May 31, 2016

(54) DISPLAY MODULE FOR A TIMEPIECE INCLUDING A SOLAR CELL

(71) Applicant: ETA SA Manufacture Horlogere Suisse, Grenchen (CH)

(72) Inventors: Fabian Dubois, Le Locle (CH); Jean Laconte, Colombier (CH); Martin Jufer, Melchnau (CH); Stephane Leoni, Courtelary (CH); Marc Schlappach, Zosingen (CH); Mile Vidovic, Bern (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 14/785,728

(22) PCT Filed: Feb. 5, 2014

(86) PCT No.: PCT/EP2014/052192

§ 371 (c)(1),
(2) Date: Oct. 20, 2015

(87) PCT Pub. No.: WO2014/173552

PCT Pub. Date: Oct. 30, 2014

(65) Prior Publication Data

US 2016/0070238 A1 Mar. 10, 2016

(30) Foreign Application Priority Data

Apr. 24, 2013 (EP) ..... 13165115

(51) Int. Cl.

| | |
|---|---|
| ***G04B 17/04*** | (2006.01) |
| ***G04C 10/02*** | (2006.01) |
| ***G04G 9/00*** | (2006.01) |
| ***G04G 17/04*** | (2006.01) |

(52) U.S. Cl.

CPC ..... *G04G 17/045* (2013.01); *G04C 10/02* (2013.01); *G04G 9/0035* (2013.01)

(58) Field of Classification Search

CPC ... G04C 10/02; G04G 9/0023; G04G 9/0029; G04G 9/0035; G04G 17/00; G04G 17/02; G04G 17/04; G04G 17/045

USPC ..... 368/205, 223

See application file for complete search history.

(56) References Cited

U.S. PATENT DOCUMENTS 4,218,872 A * 8/1980 Ikegami ..... G04B 19/06 368/232

4,257,115 A 3/1981 Hatuse et al.

(Continued)

FOREIGN PATENT DOCUMENTS

| | | |
|---|---|---|
| DE | 198 57 997 | 8/1999 |
| JP | 10 82871 | 3/1998 |
| JP | 10 82872 | 3/1998 |

OTHER PUBLICATIONS

International Search Report Issued Mar. 3, 2014 in PCT/EP14/052192 Filed Feb. 5, 2014.

*Primary Examiner* — Vit W Miska

(74) *Attorney, Agent, or Firm* — Oblon, McClelland, Maier & Neustadt, L.L.P

(57) ABSTRACT

A display module for a timepiece, including a dial, on a lower face of which is secured a digital information display device, a solar cell, and a plate. The solar cell is accommodated in the plate such that the solar cell is underneath and at a small distance from the dial. The assembly formed by the dial and the digital information display device is disposed atop the solar cell.

15 Claims, 3 Drawing Sheets

(56) References Cited

U.S. PATENT DOCUMENTS 4,261,049 A * 4/1981 Komiyama ..... G04G 17/02 368/205
4,312,056 A * 1/1982 Nishimura ..... G04G 9/087 368/21
5,222,053 A * 6/1993 Ohhira ..... G04C 19/00 368/205
6,122,226 A * 9/2000 Murakami ..... G04C 10/02 368/205
8,873,345 B2 * 10/2014 Takenawa ..... H01L 31/042 136/251

* cited by examiner

DISPLAY MODULE FOR A TIMEPIECE INCLUDING A SOLAR CELL

CROSS-REFERENCE TO RELATED APPLICATIONS

This is a National phase Application in the United States of International patent Application PCT/EP2014/052192 filed Feb. 5, 2014 which claims priority on European patent Application 13165115.0 filed Apr. 24, 2013. The entire disclosure of the above patent application are hereby incorporated herein by reference.

The present invention concerns a timepiece including a digital information display device. More precisely, the invention concerns such a timepiece in which the digital information display is more attractive and easier to read.

Wristwatches provided with a digital information display device, such as a liquid crystal cell, have been known for a long time. Such wristwatches typically include a dial, under and away from which is arranged, for example, a liquid crystal cell. An aperture provided in the watch dial allows the user to read the time or other information displayed by the liquid crystal cell. The liquid crystal cell is secured on a main plate housed in the watch case away from the dial. There is therefore an unattractive space between the surface of the dial and the display surface of the liquid crystal cell. Further, depending on the angle at which the user looks at the watch, his view may be impaired by the shadow projected by the edges of the aperture onto the liquid crystal cell display surface.

Further, the liquid crystal cells fitted to wristwatches of the aforecited type usually include glass substrates joined to each other by means of a sealing frame. These glass substrates are usually of square or rectangular shape since, although it is technically possible to give such glass substrates shapes other than a square or rectangle, this is difficult to envisage from an economic point of view.

DE Patent No 19857997 discloses a dial under the surface of which a liquid crystal cell and a solar cell are simultaneously fixed.

It is an object of the present invention to overcome the aforementioned problems, in addition to others, by providing a timepiece fitted with a digital information display device in which the display of information is more attractive and easier to read.

To this end, the present invention concerns a display module for a timepiece, this display module including, on the one hand, a dial on a lower face of which is secured a digital information display device, and on the other hand, a solar cell and a plate, the solar cell being accommodated in the plate such that the solar cell is underneath and at a small distance from the dial, the assembly formed by the dial and the digital information display device being disposed atop the solar cell. Advantageously, the display module is completed by a backlight device disposed on a lower face of the plate and removably secured thereto.

There is thus obtained a complete display module which can be exchanged, part for part, in the event of malfunction. In the event of a problem, it is even possible to remove the display module and only replace the defective component(s), which is very advantageous from an economic point of view.

The present invention also concerns a method for manufacturing a timepiece including a dial underneath which is disposed a digital information display device, an aperture provided in the watch dial allowing the user to read the information displayed by the digital information display device, the dial having an upper face and a lower face and the digital information display device having an upper information display surface, the method being characterized in that the upper information display surface is provided with an adhesive layer and in that the digital information display device is laminated on the lower face of the dial by means of the adhesive layer.

According to a complementary feature of the invention, once the digital information display device is secured to the dial, the assembly is placed in an autoclave in order to expel any air trapped between the adhesive layer and the dial. Preferably, the pressure in the autoclave is 6 bars, the treatment temperature is on the order of 50° C. and the treatment time is around 30 minutes.

Other features and advantages of the present invention will appear more clearly from the following detailed description of an example embodiment of the timepiece according to the invention, this example being given solely by way of non-limiting illustration with reference to the annexed drawing, in which.

The present invention proceeds from the general inventive idea which consists, in the case of a timepiece including a dial on the lower face of which is fixed a digital information display device, in removably housing a solar cell in a plate disposed under the dial. In the event of failure of the digital information display device or the solar cell, it is possible to remove the display module and replace only the defective component(s), which is very advantageous from an economic point of view. In particular, if the solar cell fails, it is not necessary to remove the dial which is an expensive component.

Figure 1:
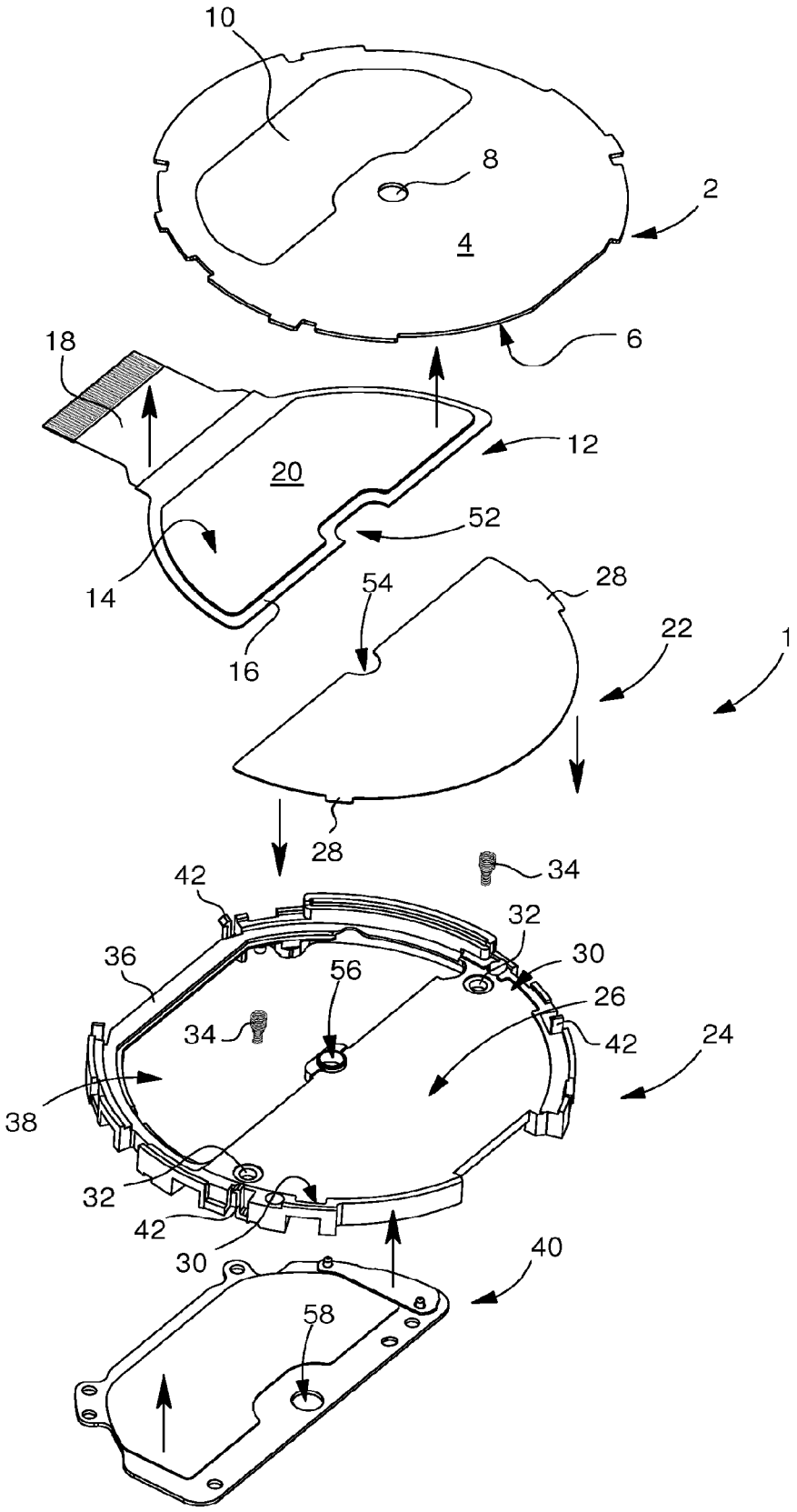
FIG. 1 is an exploded perspective view of a first embodiment of the timepiece according to the invention.

FIG. 1 is an exploded perspective view of a first example embodiment of a display module for a timepiece according to the invention. Designated as a whole by the general reference numeral 1, this display module includes a dial 2 which, in the illustrated example, is of generally circular shape. It will be understood, however, that the shape of the dial may differ from a circular profile and may, for example, be square or rectangular. Dial 2 has an upper face 4 and a lower face 6 and is pierced at the centre with a hole 8 for the passage of a set of arbors for the hour and minute hands (not shown in the drawing). An aperture 10 is provided in dial 2. In the case where dial 2 is made of a transparent material, the decorative layer coating dial 2 is omitted from the place corresponding to aperture 10. Another solution for forming aperture 10 consists in piercing dial 2 at the desired location.

Display module 1 also includes a digital information display device. In the example shown in the drawing, this digital information display device is formed of a flexible liquid crystal display cell 12 which has a substantially semi-circular shape. This liquid crystal display cell 12 includes a front substrate 14, which defines an upper display surface, and a rear substrate 16. Front substrate 14 and rear substrate 16 are made from a flexible plastic material and connected to each other in a conventional manner by a sealing frame (not shown in the drawing) which delimits a closed volume for containing the liquid crystal. It goes without saying that this example is given purely by way of illustration and that the digital information display device may be of the electrophoretic type or even use an electronic ink. A flexible electrical connector 18 connects the electrodes of the liquid crystal display cell 12 to an electronic control circuit (not shown).

According to the invention, the front substrate 14 of liquid crystal display cell 12 is coated with an adhesive layer 20 formed of an optically transparent adhesive and by means of which liquid crystal display cell 12 is attached to the lower face 6 of dial 2. Preferably, but in a non-limiting manner, liquid crystal display cell 12 is mechanically laminated against lower face 6 of dial 2, then the assembly formed by dial 2 and liquid crystal display cell 12 is placed in an autoclave in order to expel any air trapped between adhesive layer 20 and dial 2. By way of example, the pressure in the autoclave is 6 bars, the treatment temperature is on the order of 50° C. and the treatment time is around 30 minutes.

The assembly is completed by a first solar cell 22. It will be understood that utilisation of this solar cell 22 corresponds to the preferred embodiment of the invention but that, in the basic variant of the invention, display module 1 includes only dial 2 and liquid crystal display cell 12. In the example illustrated in FIG. 1, solar cell 22 has a substantially semi-circular shape complementary to the shape of liquid crystal display cell 12. The sum of the area of liquid crystal display cell 12 and solar cell 22 substantially corresponds to the area of dial 2.

Solar cell 22 is disposed underneath and at a small distance from dial 2. It is therefore accommodated in a plate 24 whose dimensions and shape are adapted to those of dial 2. For axially maintaining solar cell 22, plate 24 includes a bearing surface 26, the area of which is substantially equal to that of solar cell 22. For radially maintaining solar cell 22, the outer perimeter thereof is provided with at least one, and preferably with two lugs 28, which are engaged in two corresponding housings 30 provided on the periphery of plate 24. As shown in the drawing, bearing surface 26 is pierced with two diametrically opposite through holes 32 in which are engaged springs 34, which ensure the electrical contact between the two terminals of solar cell 22 and the electric power supply circuit of the watch (not shown).

The assembly formed by dial 2 and liquid crystal display cell 12 is disposed atop solar cell 22 and rests on a peripheral rim 36 of plate 24. It is seen that liquid crystal display cell 12 is plumb with an opening 38, which is provided in plate 24 and whose area substantially corresponds to the area of liquid crystal display cell 12. This opening 38 allows a backlight device 40 mounted from underneath plate 24 to backlight liquid crystal display cell 12.

Finally, the assembly formed by dial 2, liquid crystal display cell 12 and solar cell 22 is removably locked on main plate 24 by means of flexible locking hooks 42. There is thus obtained a complete display module 1 which can be exchanged, part for part, in the event of malfunction. In the event of a problem, it is even possible to remove display module 1 and only replace the defective component(s), which is very advantageous from an economic point of view.

Figure 2:
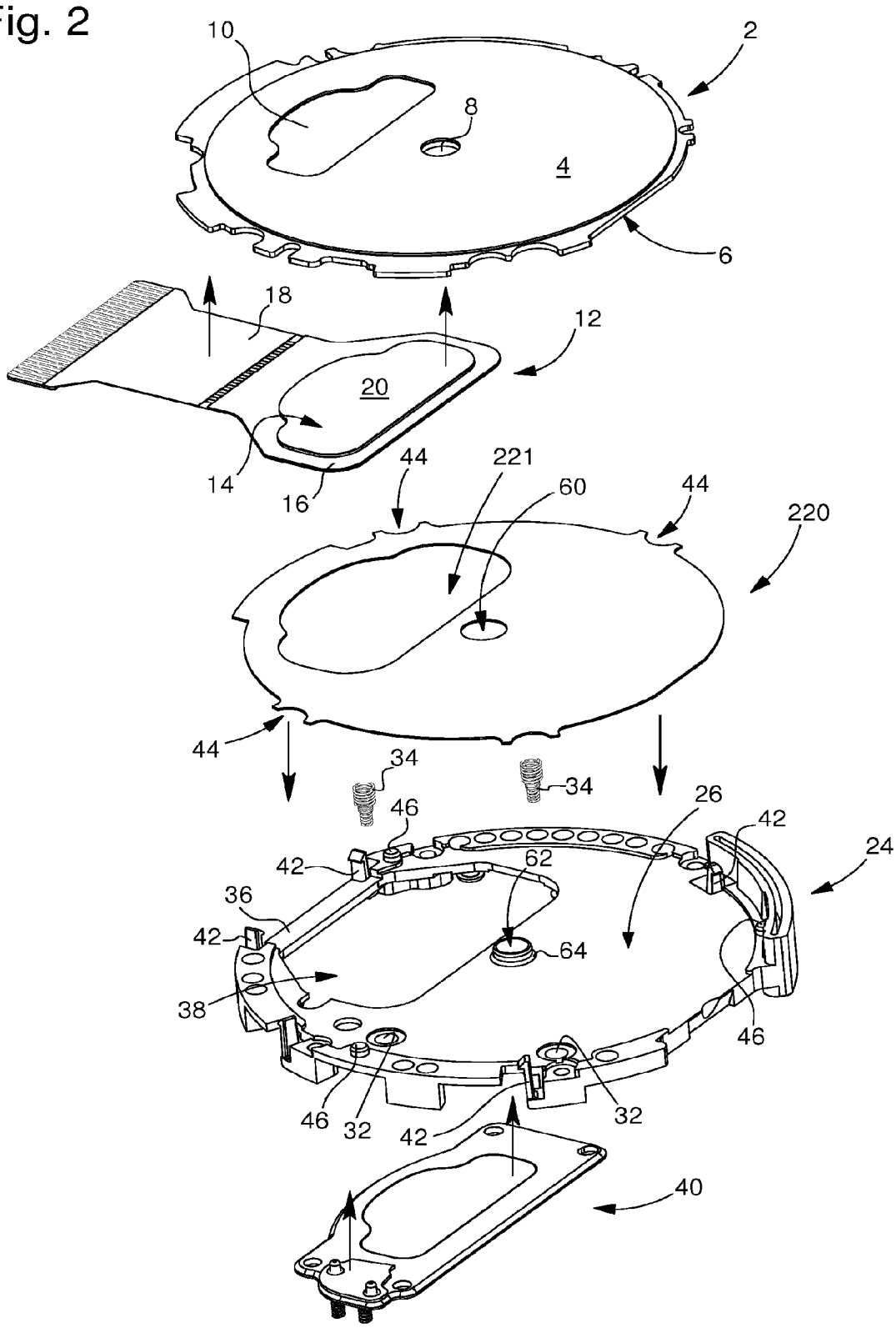
FIG. 2 is an exploded perspective view of a second embodiment of the timepiece according to the invention.

FIG. 2 is an exploded perspective view of a second example embodiment of a display module for a timepiece according to the invention. In the following description, any elements similar or identical to those already described with reference to FIG. 1 will be designated by the same reference numerals.

FIG. 2 shows that dial 2 includes an aperture 10 whose dimensions and shape are adapted to those of front substrate 14 which defines the upper display surface of liquid crystal display cell 12. It is also seen that a second solar cell 220 has substantially the same dimensions as dial 2 and is provided with an opening 221 which houses liquid crystal display cell 12 when solar cell 220 is disposed underneath dial 2. It is understood that, when a solar cell of the same dimensions as dial 2 is placed underneath dial 2, part of the surface of the solar cell will be concealed by liquid crystal display cell 12. It was realised that the photovoltaic conversion efficiency of a solar cell with a given active surface is worse when the solar cell is partially obscured than when the active surface of the solar cell is reduced due to the presence of a shaped opening in which the digital information display device is housed.

Otherwise, the display module illustrated in FIG. 2 is identical to that described above with reference to FIG. 1. Liquid crystal display cell 12 is secured to the lower face 6 of dial 2, preferably by lamination, and solar cell 220 is accommodated in plate 24. Thereafter, the assembly formed by dial 2 and liquid crystal display cell 12 is disposed atop solar cell 220, so that solar cell 220 is underneath and at a small distance from dial 2 and liquid crystal display cell 12 is housed inside opening 221. A backlight device 40 mounted from underneath main plate 24 backlights liquid crystal display cell 12 through the opening 38 provided in plate 24. The assembly formed by dial 2, liquid crystal display cell 12 and solar cell 220 is removably locked on plate 24 by means of a plurality of flexible locking hooks 42.

As seen in the drawing, bearing surface 26 is pierced with two through holes 32 which are disposed in proximity to each other on a portion of the diameter of bearing surface 26, and in which are engaged springs 34 which ensure the electrical contact between the two terminals of solar cell 220 and the electric power supply circuit of the watch (not shown). It is also seen that, to radially maintain solar cell 220, at least one, and preferably three notches 44, which cooperate with three corresponding lugs 46 of plate 24, are provided at the periphery of solar cell 220.

In the case where the timepiece is of the solar watch type, dial 2 must be at least partially transparent in order to allow through a sufficient amount of light for solar cell 22, 220 to efficiently charge the watch battery while concealing the solar cell 22, 220 from the wearer's view.

By way of example, dial 2 may be made of a transparent plastic material and be coated with a layer of paint, the opacity of which is adjusted according to the thickness of the paint layer and/or the concentration of pigments in the paint. The transmittance of a transparent plastic dial 2 coated with paint is on the order of 45%. In other words, 45% of the incident light is transmitted to solar cell 22, 220 and the rest of the light is absorbed by dial 2, which is sufficient to conceal solar cell 22, 220 from the user's view. According to another example, plastic dial 2 may be coated with a mother-of-pearl layer whose thickness is typically 150 μm±20 μm and whose transmittance is adjusted to 35%. The mother-of-pearl layer is fixed to upper surface 4 of dial 2 by means of a layer of optically transparent adhesive.

According to another aspect of the invention, it is sought to give plastic dial 2 the appearance of a carbon fibre type composite material. It is known that such a composite material is obtained by means of intertwined carbon fibres impregnated with resin, the surface state of the resulting material having periodically repeated slightly raised areas.

Figure 3A:
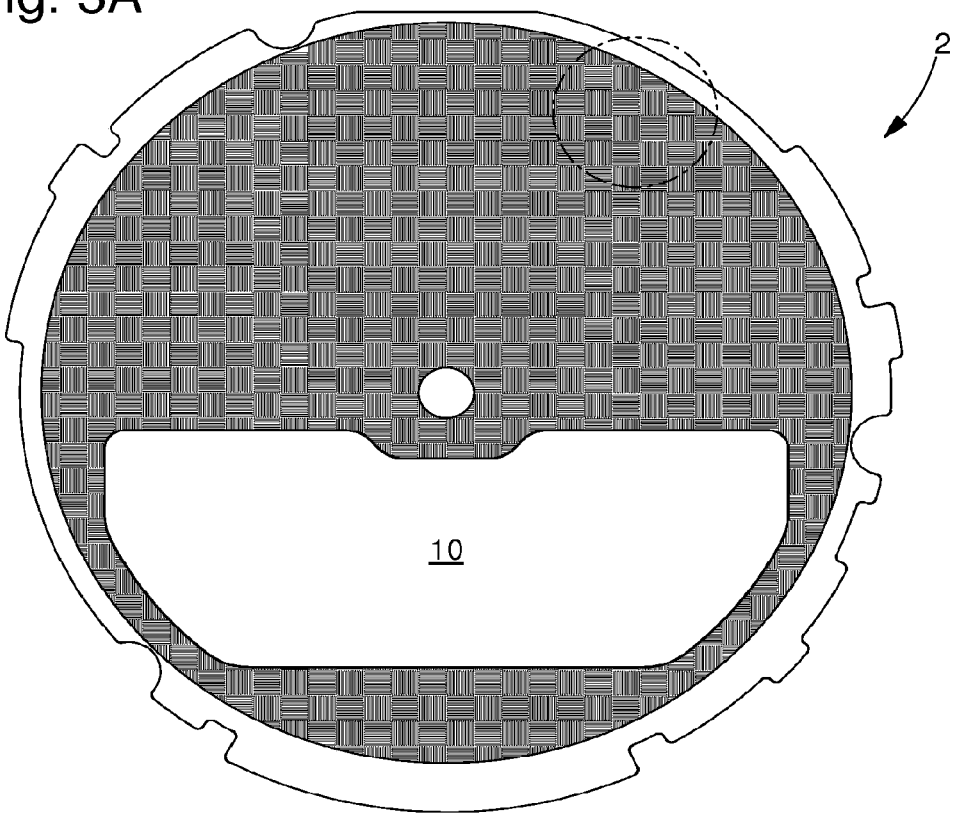
FIGS. 3A and 3B are respectively an overview and larger scale view of a plastic dial which is given a composite material appearance of the carbon fibre type.
Figure 3B:
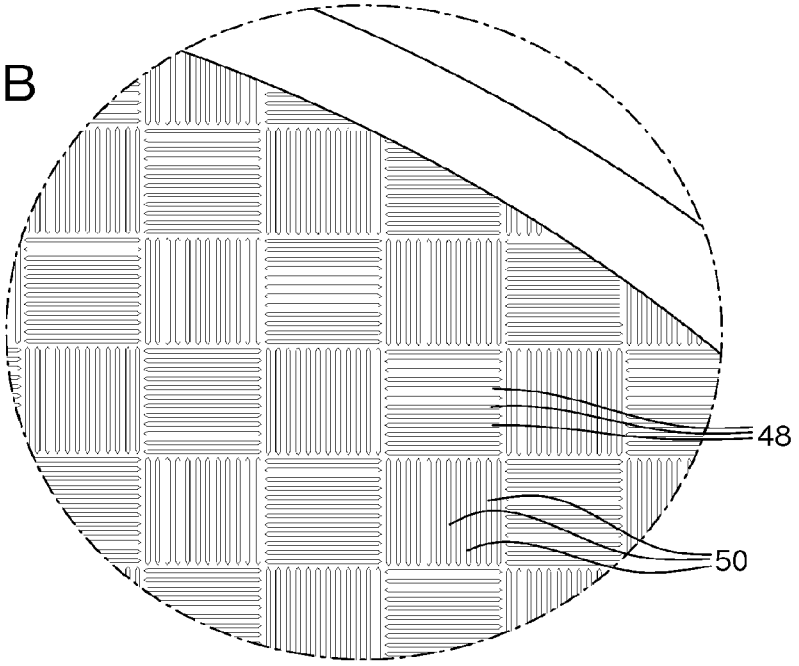

To imitate this texture, two solutions are envisaged. The first solution consists in machining structured portions in the inner wall of the mould into which the plastic material is injected which will form as many raised areas on the surface of dial 2. The second solution uses the principle of conventional pad printing (transfer with a cliché) or electronic printing, which can also be envisaged from a technical point of view, but which provides a slightly less satisfactory finish to the eye. As illustrated in FIGS. 3A and 3B annexed to this Patent Application, the carbon effect is obtained by the alternate and periodic repetition of horizontal lines 48 and vertical lines 50. Although horizontal lines 48 seem lighter, this is only due to the angle of incidence of the light. This effect makes it possible to bring the dial "to life" with light and this is exactly the same as with real carbon. The lines are black (horizontal lines and vertical lines). A mixture of black (vertical lines) and grey (horizontal lines) could also have been used to obtain the carbon effect, but in that case the effect would be independent of light and quite static.

It goes without saying that the present invention is not limited to the embodiments that have just been described and that various simple modifications and variants can be envisaged by those skilled in the art without departing from the scope of the invention as defined by the annexed claims. It will be noted, in particular, that in the embodiment illustrated in FIG. 1, liquid crystal display cell 12 and the first solar cell 22 each have a recess, respectively 52 and 54, for the passage of the hour and minute hand arbors. Likewise, a through hole 56 is provided on the edge of bearing surface 26 of main plate 24 and backlight device 40 is pierced with a hole 58. In a similar manner, the second solar cell 220 is pierced at the centre with a hole 60 and plate 24 is provided with a hole 62 delimited by a guide collar 64.

The invention claimed is:

1. A display module for a timepiece, comprising:

a dial on a lower face of which is directly secured a digital information display device;

a solar cell; and a plate;

wherein the solar cell is accommodated resting on an upper side of the plate on a first bearing surface, and wherein an assembly formed by the dial and the digital information display device is accommodated resting on the upper side of the plate on a second bearing surface of the plate, wherein the assembly covers the solar cell.

2. The display module according to claim 1, wherein the assembly formed by the dial and the digital information display device and the solar cell are removably secured to an upper side of the plate.

3. The display module according to claim 2, wherein the assembly formed by the dial and the digital information display device and the solar cell are removably locked on the plate by flexible locking hooks.

4. The display module according to claim 1, wherein a backlight device is disposed on a lower side of the plate and is removably secured thereto.

5. The display module according to claim 2, wherein a backlight device is disposed on a lower side of the plate and is removably secured thereto.

6. The display module according to claim 3, wherein a backlight device is disposed on a lower side of the plate and is removably secured thereto.

7. The display module according to claim 4, wherein, for axially maintaining the solar cell, the plate includes a bearing surface, the area of which is substantially equal to that of the solar cell, and wherein, for radially maintaining the solar cell, the outer perimeter thereof includes at least one lug or notch that cooperates with a housing, respectively with a corresponding notch provided on the periphery of the plate.

8. The display module according to claim 5, wherein, for axially maintaining the solar cell, the plate includes a bearing surface, the area of which is substantially equal to that of the solar cell and wherein, for radially maintaining the solar cell, the outer perimeter thereof includes at least one lug or notch that cooperates with a housing, respectively with a corresponding notch provided on the periphery of the plate.

9. The display module according to claim 6, wherein, for axially maintaining the solar cell, the plate includes a bearing surface, the area of which is substantially equal to that of the solar cell and wherein, for radially maintaining the solar cell, the outer perimeter thereof includes at least one lug or notch that cooperates with a housing, respectively with a corresponding notch provided on the periphery of the plate.

10. The display module according to claim 7, wherein the assembly formed by the dial and the digital information display device is disposed atop the solar cell and rests on a peripheral rim of the plate, wherein the digital information display device is situated plumb with an opening which is provided in the plate and the area of which substantially corresponds to the area of the liquid crystal display cell, wherein the opening allows the backlight device, mounted from underneath the plate, to backlight the digital information display device.

11. The display module according to claim 8, wherein the assembly formed by the dial and the digital information display device is disposed atop the solar cell and rests on a peripheral rim of the plate, the digital information display device being situated plumb with an opening which is provided in the plate and the area of which substantially corresponds to the area of the liquid crystal display cell, said opening allowing the backlight device, mounted from underneath the plate, to backlight the digital information display device.

12. The display module according to claim 9, wherein the assembly formed by the dial and the digital information display device is disposed atop the solar cell and rests on a peripheral rim of the plate, the digital information display device being situated plumb with an opening which is provided in the plate and the area of which substantially corresponds to the area of the liquid crystal display cell, said opening allowing the backlight device, mounted from underneath the plate, to backlight the digital information display device.

13. A method for manufacturing a timepiece including a dial underneath which is disposed a digital information display device, wherein an aperture provided in the watch dial allows a user to read information displayed by the digital information display device, wherein the dial has an upper face and a lower face and the digital information display device has an upper information display surface, wherein the method comprises:

providing the upper information display surface with an adhesive layer; and wherein the digital information display device is laminated on the lower face of the dial by the adhesive layer.

14. The method according to claim 13, wherein, once the digital information display device has been secured to the dial, the assembly is placed in an autoclave to expel any air trapped between the adhesive layer and the dial.

15. The method according to claim 14, wherein pressure in the autoclave is 6 bars, treatment temperature is on an order of 50° C., and a treatment time is around 30 minutes.

* * * * *